US005616068A

United States Patent [19]

Söderberg

[11] Patent Number: 5,616,068

[45] Date of Patent: Apr. 1, 1997

[54] METHOD AND APPARATUS FOR GRINDING PERIPHERAL GROOVES IN ROLLING MILL GUIDE ROLLERS

[75] Inventor: Lennart Söderberg, Smedjebacken, Sweden

[73] Assignee: Morgardshammar AB, Smedjebaken, Sweden

[21] Appl. No.: 549,807

[22] PCT Filed: Jun. 8, 1994

[86] PCT No.: PCT/SE94/00554

§ 371 Date: Dec. 7, 1995

§ 102(e) Date: Dec. 7, 1995

[87] PCT Pub. No.: WO94/29076

PCT Pub. Date: Dec. 22, 1994

[51] Int. Cl.[6] ..... B24B 1/00

[52] U.S. Cl. ..... 451/49; 451/123; 451/142; 451/242; 451/397; 451/428

[58] Field of Search ..... 457/49, 51, 52, 457/178, 142, 241, 252, 242, 254, 397, 402, 428, 123, 143, 243, 439; 72/250, 428; 29/895.3; 492/1, 16, 30

[56] References Cited

U.S. PATENT DOCUMENTS

| | | | |
|---|---|---|---|
| 3,616,671 | 11/1971 | Notari | 492/2 |
| 3,745,718 | 7/1973 | Peebles | 51/241 S |
| 3,765,214 | 10/1973 | Boehmer | 72/250 |
| 4,070,892 | 1/1978 | Kholmogorov et al. | 492/1 |
| 4,300,265 | 11/1981 | Heinen | 492/30 |
| 4,800,682 | 1/1989 | Wolters et al. | 451/123 |
| 4,827,751 | 5/1989 | Holthoff | 451/49 |
| 5,134,910 | 8/1992 | Morikuni et al. | 451/49 |

FOREIGN PATENT DOCUMENTS

| | | | |
|---|---|---|---|
| 2916708 | 11/1980 | Germany . | |
| 407602 | 12/1973 | U.S.S.R. | 72/250 |
| 884775 | 11/1981 | U.S.S.R. | 72/250 |
| 1321972 | 7/1973 | United Kingdom . | |

*Primary Examiner*—Robert A. Rose
*Assistant Examiner*—George Nguyen
*Attorney, Agent, or Firm*—Nies, Kurz, Bergert & Tamburro

[57] ABSTRACT

The present invention relates to a method for grinding grooves in the peripheral surface of rollers roller guides for rolling mills. The roller (2) of a roller guide is caused to rotate while retained on its own bearing (8,9,10) as the peripheral groove is ground.

The invention also relates to an apparatus for carrying out the method, and to a roller guide structure with which the method can be applied.

10 Claims, 2 Drawing Sheets

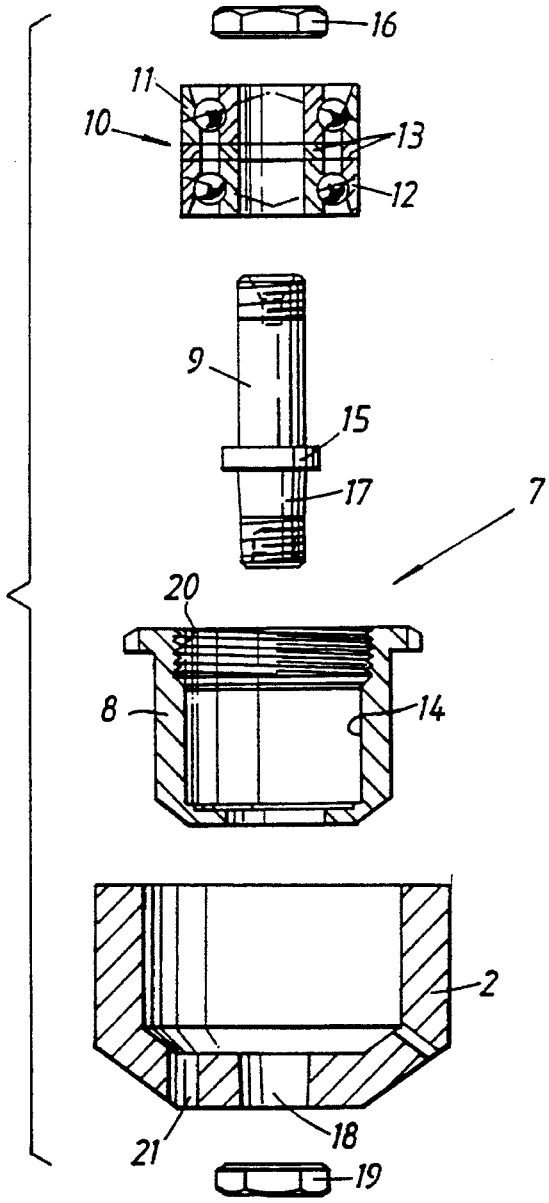
Fig. 4
Fig. 5
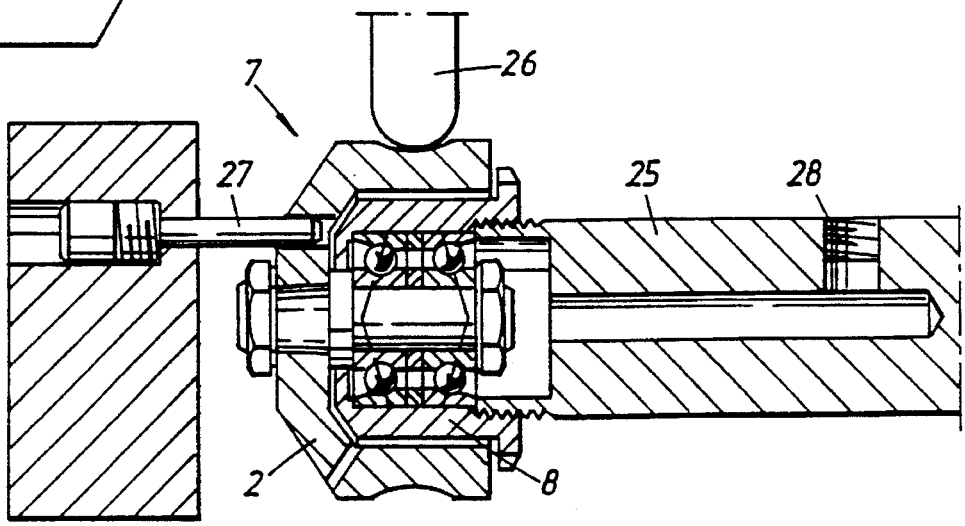

METHOD AND APPARATUS FOR GRINDING PERIPHERAL GROOVES IN ROLLING MILL GUIDE ROLLERS

BACKGROUND OF THE INVENTION

1. Field of the Invention

The present invention relates to a method and to a device for grinding the rollers of rolling mill roller-guides, and a roller guide which enables the method to be carried out.

2. Description of the Related Art

High demands are placed on the bearings of guide rollers of the kind which function to guide rolled metal in between the rolls of a rolling mill, with the intention of preventing a bearing fracture that would interrupt continuity in production. Ideally, the guide bearings will have the same useful life span as the mill rolls. This aim has not been achieved in practice, despite endeavors to eliminate play in the bearings and to prevent bias loads acting thereon, by using pre-stressed precision bearings which are press-fitted into their respective bearing surfaces. This problem is particularly accentuated in modern rolling mills in which rolling speeds will reach 100 m/sec, and particularly in the final stage of the rolling mill where the guide rollers are required to rotate at very high speeds. The useful life span of present day roller guide bearings is not sufficiently long to permit still higher rolling speeds and the higher loads on the mill guide rollers that are occasioned by these higher rolling speeds.

The object of the present invention is to increase the life span of roller guide bearings in rolling mills.

SUMMARY OF THE INVENTION

According to the present invention this object is achieved with a method of grinding circumferential grooves in the roller-guide rollers of rolling mills, characterized in that the guide rollers are caused to rotate in their own bearings while grinding a groove. In this way, the groove formed in the roller will always lie precisely at right angles to the rotational axis of the roller and the rolled metal will move precisely in the rolling line.

The invention also relates to a device for carrying out the method, said device being characterized in that it includes a carrier which supports a roller-guide roller and its bearing such as to enable the roller to rotate freely in its bearing, a grinding tool which is movable in a radial direction relative to a roller supported by the carrier, and means for rotating the roller.

BRIEF DESCRIPTION OF THE DRAWINGS

A roller guide constructed in accordance with the invention is characterized in that the roller-guide roller and its bearing are built together to form a unit which can be readily detached from the remainder of the guide.

An exemplifying embodiment of the invention will now be described in more detail with reference to the accompanying drawings, in which

FIG. 4 illustrates the roller and the roller bearing of a roller guide according to FIG. 3; and FIG. 5 illustrates schematically an embodiment of an inventive device for grinding grooves in the roller illustrated in FIGS. 1–4.

DESCRIPTION OF THE PREFERRED EMBODIMENTS

FIGS. 1 to 4 illustrate a roller guide for rolling mills, said guide being constructed to permit the inventive grinding method to be applied. The roller guide includes conventionally two circumferentially grooved and rotatable rollers 1 and 2 which guide rolled material 3 (see FIG. 2) therebetween in a metal rolling operation. The rollers 1 and 2 are carried by arms 4, 5, which are in turn carried by a holder 6.

Figure 1:
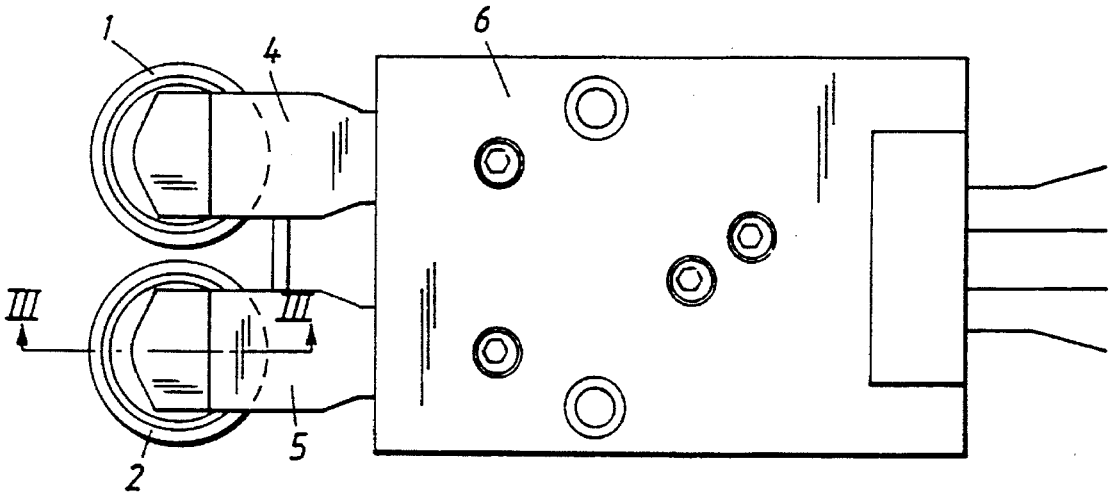
FIG. 1 illustrates from above one embodiment of an inventive roller guide.
Figure 2:
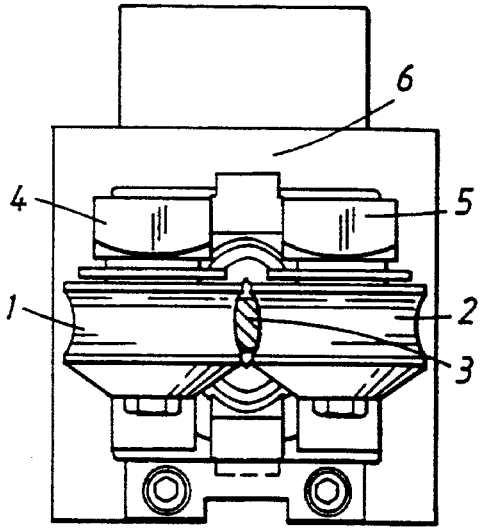
FIG. 2 is a front view of the guide shown in FIG. 1.
Figure 3:
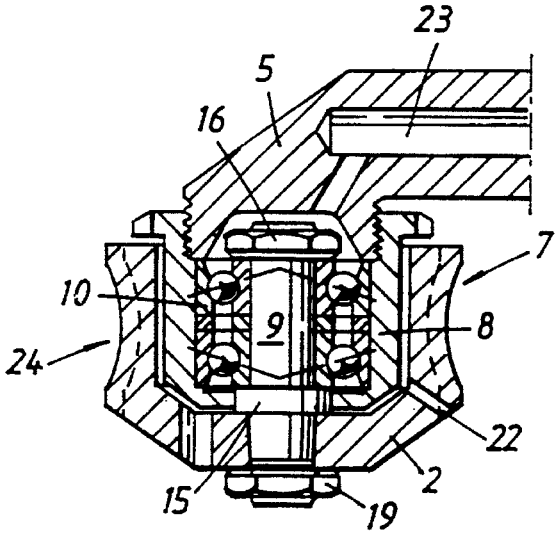
FIG. 3 is a sectional view taken on the line III—III in FIG. 1.

In accordance with the invention, the rollers 1, 2 and their respective journals or bearings have the form of units 7 which can be readily attached to and removed from the arms 4, 5. FIG. 4 is an exploded view of one such unit 7. In addition to the roller 2, this unit also includes an attachment sleeve 8, a bearing shaft 9 and a bearing part 10 which is comprised of two pairs of angle contact bearings 11, 12 which are separated by two co-ground spacing rings 13 which are intended to impart a suitable axial bias to the bearings. As best seen from FIG. 3, the bearing part 10 is press-fitted into a seating means 14 in the attachment sleeve 8 and is pressed against an abutment collar 15 on the bearing shaft 9 by means of a nut 16 screwed onto the upper part of the bearing shaft as seen in FIGS. 3 and 4. The bearing shaft 9 includes beneath the abutment collar 15 a slightly conical part 17 which fits into a central recess or aperture 18 with the same conicity in the roller 2, and the bottom end of the bearing shaft is terminated with a cylindrical screw thread as seen in FIGS. 3 and 4. The roller 2 is urged against the underside of the abutment collar on the bearing shaft 9, by tightening a nut 19. As will be seen from FIGS. 3 and 4, the abutment collar 15 is thicker than the underside of the attachment sleeve 8.

In order to enable the unit 7 to be attached to the arm 5, an upper part 20 of the attachment sleeve 8 has an internal screw thread which enables the unit 7 to be screwed onto a corresponding external screw thread on the arm 5. FIG. 3 shows the unit 7 attached to the arm 5. The direction in which the unit is screwed onto the arm coincides with the direction in which the roller 2 rotates in operation, therewith ensuring that the attachment sleeve will not be unscrewed from the arm 5 as roller 2 rotates. Thus, one of the units 7 has a left-hand thread and the other a right-hand thread. The units 7 belonging to respective rollers 1 and 2 are of identical construction with the exception of these different thread directions.

The roller 2 includes a cylindrical recess or aperture 21 which extends parallel with but eccentrically to the rotational axis of the roller, and also a drainage passage 22 through which coolant sprayed onto the roller during operation is drained-off. The arm 5 also includes air or lubricant passageways 23.

When a rolling mill that includes a roller guide of the aforedescribed kind is operating, the rolled metal that passes through the mill will cause the rollers 1, 2 to rotate together with the bearing shafts 9 and the inner bearing rings, whereas the attachment sleeves 8 and the outer bearing rings will remain stationary.

The described roller guides are intended for use in the final stages of a rolling mill and are constructed to permit rolling speeds of up to 170 m/sec. Since the rollers then have a diameter of about 45 mm, they will rotate at very high speeds, resulting in bias on the bearings, causing the bearings to wear rapidly causing subsequent production stoppages in order to effect a bearing change. It is not unusual for this load bias on the bearings to occur because the roller guide grooves are not truly at right angles to the rotational axis of the rollers, owing to the fact that the axis of the tool that has produced the peripheral guide groove was not perfectly coaxial with the rotational axis of the roller bearing.

In order to eliminate this error source, it is proposed in accordance with the invention that the peripheral guide groove of a roller in a roller guide is formed by rotating the roller in its own bearing, and the aforedescribed roller guide is constructed to this end.

FIG. 5 illustrates an embodiment of a device for grinding a guide groove 24 in the roller 2 of the roller guide described with reference to.

This device includes a holder 25 for a unit 7 comprised of a circumferential roller-guide roller seated in its bearing, wherein the illustrated holder includes an arm which is provided with an external screw thread corresponding to the internal screw thread on the upper part of the attachment sleeve 8. A grinding disc 26 is mounted on the upper side of the arm 25 in FIG. 5, opposite the cylindrical outer surface of the roller 2 of a unit 7 mounted on the arm 25. This grinding disc 26 is rotatable about an axis that extends parallel with the axis of the arm 25, and thus also parallel with the rotational axis of the roller 2. The grinding disc can also be moved in a direction perpendicular to the axis of the arm 25. Finally, the device also includes means for rotating a fitted roller 2. In the case of the illustrated embodiment, this drive means comprises a pin 27 which is rotatable about an axis coinciding with the axis of the arm 25 and is located radially outside its rotational axis at the same distance therefrom as the distance of the aperture 21 in the roller 2 from the rotational axis of said roller, and also has a smaller diameter than said aperture.

The described device operates as follows:

After having fitted the unit 7 onto the holder 25 and inserted the pin 27 into the aperture 21 in the roller, driving of the pin 27 is initiated and rotation of the grinding disc 26 i started. The grinding disc and the pin are preferably rotated in different directions, although they may, of course, be rotated in mutually the same direction but at different speeds. As material is removed from the roller, the grinding disc is moved radially towards the center of the roller until the peripheral groove thus obtained in the roller 2 has received the desired shape. Air is injected towards the unit 7 through the inlet 28 provided in the arm 25, with the intention of avoiding the ingress of grinding fragments, dust and other contaminant particles into the bearings. Because the diameter of the hole 21 is larger than the diameter of the pin 27 its rotational axis can be displaced slightly in relation to the rotational axis of the roller 2 without subjecting the roller to biasing loads.

As will be understood, because the roller 2 rotates in its own bearing while being ground, it is ensured that the groove 24 formed in the roller will lie exactly at right angles to the axis around which the roller 2 rotates during a rolling process, and that no biasing forces will act on the bearings 11, 12 during a rolling process, by virtue of the fact that when forming the groove in the roller the roller or the groove-forming tool rotates about an axis which is slightly inclined to the axis about which the roller rotates in a mill rolling operation.

It will be understood that the described device is also used to grind the roller 2 in the aforedescribed manner on subsequent occasions, when the groove becomes worn. FIG. 3 illustrates in broken lines the contour of a roller 2 which has been ground down to a maximum.

It will be understood that the described device can be modified within the scope of the invention. For instance, the guide roller can be rotated by means other than the pin 27, for instance by means of roller driving means that are in contact with the outer cylindrical surface of the roller 2. Furthermore, the grinding disc may be stationary and the arm 25 and the means for rotating the roller may be movable at right angles to the rotational axis of the roller. The invention method can also be applied to other types of rollers with other types of bearings, provided that the roller and its bearing can be removed as a unit from the remainder of the roller guide. The invention is therefore restricted solely by the contents of the following claims.

What is claimed is:

1. A method for grinding a circumferential groove in the periphery of a rolling mill guide roller, said method comprising:

a. providing a unit consisting of guide roller and its operating bearing assembly, which as a unit can be readily attached to and removed from a rolling mill stand;

b. attaching said unit to a support of a grinding device that is separate from the rolling mill stand;

c. grinding a circumferential groove in the periphery of the guide roller of said unit, the guide roller being rotatably supported in its operating bearing assembly.

2. A method according to claim 1, wherein the step of grinding a circumferential groove includes bringing a rotating grinding disc radially into contact with the periphery of the roller; and rotating the roller at a peripheral speed different from the speed at which the grinding disc is rotated.

3. A method according to claim 1, including the step of injecting air under pressure against an inner surface of the roller during the grinding step.

4. A device for grinding circumferential grooves in guide rollers of rolling mills while the guide rollers are separated from a rolling mill and are carried on guide roller operating bearing assemblies, said device comprising: a holder for rotatably supporting a guide roller having a peripheral surface and a guide roller operating bearing assembly so that the guide roller is able to rotate freely about an axis of rotation while carried on its operating bearing by the holder, a grinding tool spaced radially outwardly from the guide roller axis of rotation and movable radially toward and away from the guide roller peripheral surface while the guide roller is supported by the holder, and roller rotating means for rotating the guide roller about its axis of rotation.

5. A device according to claim 4, wherein the guide roller includes a drive aperture spaced from the guide roller axis of rotation, and wherein the roller rotating means includes a drive pin engageable with the drive aperture for rotationally driving the guide roller about its axis of rotation.

6. A roller guide for rolling mills, said roller guide comprising: a roller having an axis of rotation, a bearing shaft defining a roller axis of rotation, a bearing carried by the bearing shaft for rotatably supporting the roller and bearing shaft for rotation about the roller axis of rotation, and an attachment sleeve rotatably carried by the bearing for supporting the roller and bearing shaft, wherein the attachment sleeve includes attachment means for removably attaching the roller and the bearing to a roller holder carried by a rolling mill.

7. A guide according to claim 6, wherein the attachment sleeve includes a bearing seat and the attachment means includes an internal screw thread, wherein the bearing includes ball bearings having an outer and an inner bearing ring, and wherein the bearing shaft includes an external screw thread on respective ends thereof and an abutment collar against which one side of the inner bearing part ring abuts when a opposite side of the inner bearing ring is pressed under axial bias by means of a nut screwed onto one end of the bearing shaft, and against an opposite side of which abutment collar the roller can be pressed by a nut screwed onto an opposite end of the bearing pin shaft.

8. A guide according to claim 7, wherein the roller has a cupped shape which includes a cylindrical wall and a bottom wall having a first, central axially extending aperture and a second axially extending aperture radially spaced from the first aperture.

9. A guide according to claim 6, wherein the bearing includes two angular contact bearings.

10. A guide according to claim 8, wherein on end of the bearing shaft tapers conically and wherein the first aperture in the roller has a conical shape which is complementary thereto.

* * * * *